US008491148B2

(12) United States Patent
Coushaine et al.

(10) Patent No.: US 8,491,148 B2
(45) Date of Patent: Jul. 23, 2013

(54) CHAMBERED WATERPROOF LAMP ASSEMBLY HAVING A TRANSPARENT COVER SWITCH ACTIVATOR

(75) Inventors: Charles M. Coushaine, Rindge, NH (US); Laura Peach, New Boston, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 1359 days.

(21) Appl. No.: 11/977,939

(22) Filed: Oct. 27, 2007

(65) Prior Publication Data

US 2009/0109677 A1 Apr. 30, 2009

(51) Int. Cl.
*F21V 31/00* (2006.01)
*F21L 4/00* (2006.01)

(52) U.S. Cl.
USPC ..... 362/158; 362/194; 362/267; 362/278; 362/362

(58) Field of Classification Search
USPC ..... 362/157, 158, 267, 362, 363, 277, 362/278, 183–208, 194
See application file for complete search history.

(56) References Cited

U.S. PATENT DOCUMENTS

| | | | | |
|---|---|---|---|---|
| 1,948,728 | A * | 2/1934 | Meginniss | 200/60 |
| 2,729,740 | A * | 1/1956 | Davis | 362/158 |
| 3,067,324 | A * | 12/1962 | Thompson | 362/194 |
| 3,804,411 | A * | 4/1974 | Hendry | 473/570 |
| RE29,047 | E * | 11/1976 | Brindley | 362/205 |
| 4,152,755 | A * | 5/1979 | Trosper et al. | 362/158 |
| 4,204,272 | A | 5/1980 | Kim | |
| 5,469,345 | A | 11/1995 | Pettersen et al. | |
| 5,894,611 | A | 4/1999 | Toro | |
| 6,086,218 | A | 7/2000 | Robertson | |
| 6,106,137 | A | 8/2000 | Adams et al. | |
| 6,288,498 | B1 * | 9/2001 | Cheng | 315/185 S |
| 6,336,732 | B1 * | 1/2002 | Shiau | 362/205 |
| 6,547,414 | B2 | 4/2003 | Steger | |
| 6,752,515 | B2 | 6/2004 | Evans et al. | |
| D503,007 | S | 3/2005 | Duscha et al. | |
| 6,971,761 | B2 | 12/2005 | Parsons | |

(Continued)

FOREIGN PATENT DOCUMENTS

| | | |
|---|---|---|
| CN | 2699110 | 5/2005 |
| DE | 37 12 602 A1 | 11/1987 |

(Continued)

OTHER PUBLICATIONS

Machine translation of China Utility Model CN 2699110, 20 pages.

(Continued)

*Primary Examiner* — Ismael Negron
(74) *Attorney, Agent, or Firm* — Edward S. Podszus

(57) ABSTRACT

A waterproof portable lamp (10) comprises a housing (12); a light source (14) including a plurality of LEDs, a power supply (16) for said light source (14) and a switch (18) for energizing said light source (14) contained within said housing (12). An opening (20) is formed in said housing (12) permitting egress of light when said light source (14) is energized. A flexible, transparent cover (22) is peripherally sealed to said opening (20) in a watertight manner and a switch activator (24) is substantially centrally located on and fixed to said flexible, transparent cover (22). The lamp (10) is activated be depressing the center of the flexible cover (22), which moves the switch activator (24) into contact with the switch (18).

8 Claims, 4 Drawing Sheets

U.S. PATENT DOCUMENTS

| | | | | |
|---|---|---|---|---|
| D544,117 | S | 6/2007 | Coushaine | |
| D544,618 | S | 6/2007 | Coushaine | |
| 7,390,104 | B2 * | 6/2008 | Coushaine | 362/184 |
| 2002/0018343 | A1 | 2/2002 | Steger | |
| 2005/0018419 | A1 | 1/2005 | Parsons | |
| 2005/0047122 | A1 * | 3/2005 | Kuo | 362/158 |
| 2005/0094395 | A1 | 5/2005 | Rosenberg | |
| 2006/0250789 | A1 * | 11/2006 | Coushaine | 362/157 |

FOREIGN PATENT DOCUMENTS

| | | | |
|---|---|---|---|
| DE | 195 44 807 | C2 | 6/1997 |
| JP | 6-150776 | | 5/1994 |
| JP | 03028759 | | 6/1996 |
| JP | 10-21776 | | 1/1998 |
| JP | 10-21777 | | 1/1998 |
| JP | 10-50172 | | 2/1998 |
| JP | 11232902 | | 8/1999 |
| JP | 2004-511893 | | 4/2004 |
| JP | 2008-059852 | | 3/2008 |
| KR | 10-0276508 | | 12/2000 |
| WO | WO 9312374 | A1 * | 6/1993 |
| WO | 02/33310 | A2 | 4/2002 |
| WO | 2008/026627 | | 3/2008 |

OTHER PUBLICATIONS

Partial translation of JP Appl. Publ. No. 6-150776, 1 page.
Partial translation of JP Utility Model No. 3028759, 1 page.
Partial translation of JP Patent Appl. Publ. No. 2008-059852, 1 page.
Partial translation of parts of JP Appl. Publ. No. 11-232902, 1 page.
A partial translation of Korean Patent No. 10-0276508 as provided by Korean foreign associate agent (1 page).
Patent Abstract of Japan, Publication No. 10-050172, Publication Date: Feb. 20, 1998 (1 page).
Patent Abstract of Japan, Publication No. 10-021777, Publication Date: Jan. 23, 1998 (1 page).
Patent Abstract of Japan, Publication No. 10-021776, Publication Date: Jan. 23, 1998 (1 page).

* cited by examiner

CHAMBERED WATERPROOF LAMP ASSEMBLY HAVING A TRANSPARENT COVER SWITCH ACTIVATOR

TECHNICAL FIELD

This invention relates to light sources and more particularly to portable, waterproof light sources. Still more particularly, it relates to such light sources employing light emitting diodes (LED or LEDs).

BACKGROUND ART

Recent developments in LED light sources have provided small, compact and convenient units that are easy to use and position. Such sources are epitomized by those shown in U.S. Published Patent Application 2006/0250789 A1, which was filed May 3, 2005 and is assigned to the assignee of the instant invention.

The uses for such lamps could be greatly amplified if their use in, around and/or underwater could be provided for.

DISCLOSURE OF INVENTION

It is, therefore, an object of the invention to provide a simple, convenient lamp for use in water environments.

It is another object of the invention to enhance the operation of such lamps.

These objects are accomplished, in one aspect of the invention, by the provision of a waterproof portable lamp comprising; a housing; a light source, a power supply for the light source and a switch for energizing the light source contained within the housing; an opening in the housing permitting egress of light when the light source is energized; a flexible, transparent cover peripherally sealed to the opening in a water-tight manner; and a switch activator substantially centrally located on and fixed to the flexible, transparent cover.

Utilizing the flexible cover to activate the light source greatly simplifies the device.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 3:
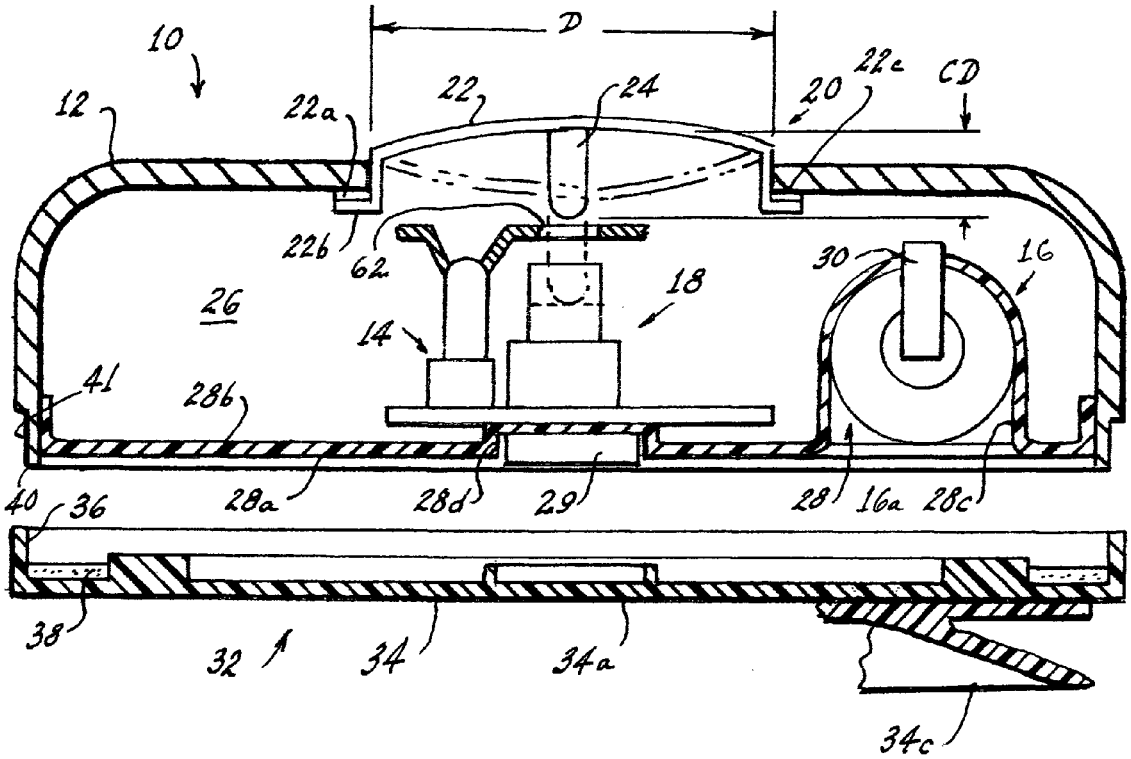
FIG. 3 is an elevational, sectional view taken along the line 3-3 of FIG. 1.
Figure 4:
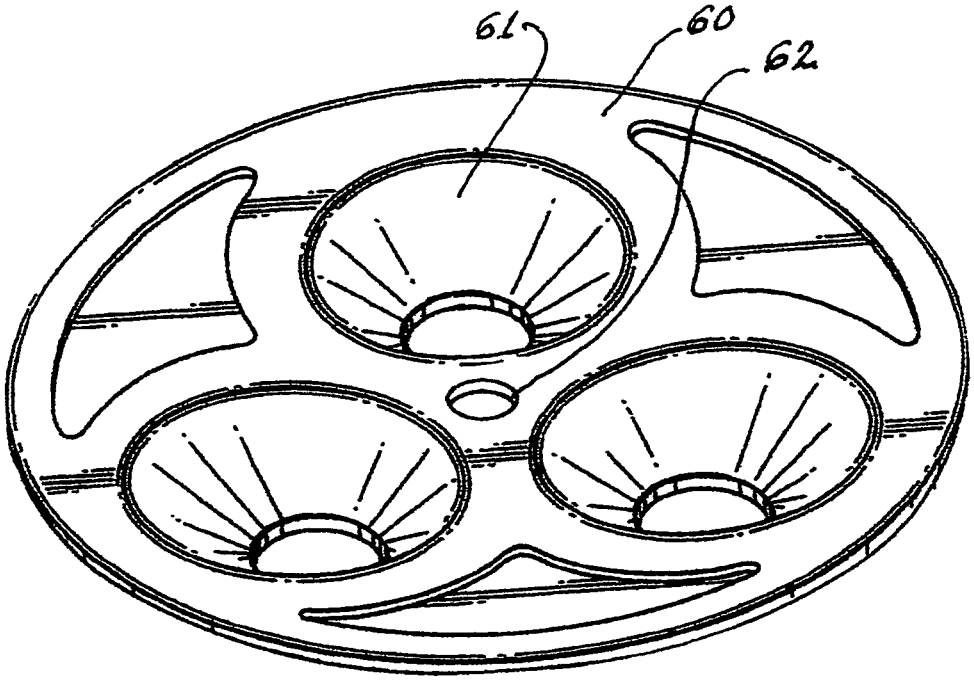
FIG. 4 is a perspective view of a reflector that can be used with the embodiment of FIG. 1.

Referring now to the drawings with particularity, there is shown in FIG. 3 a waterproof portable lamp 10 comprising a housing 12 of silicone including a first waterproof chamber 26 and a second waterproof chamber 28. A light source 14 and a switch 18 for actuating the light source 14 are positioned in the first waterproof chamber 26; and a power supply 16 for the light source 14 is positioned in the second waterproof chamber 28, the second waterproof chamber 28 being isolated from the first waterproof chamber 26 except for electrical connections 30 between the power supply 16 and the light source 14. In a preferred embodiment the light source 14 comprises a plurality, for example, three, 5 mm White Radial LEDs with an individual light output of 14,000 to 16,000 mcd. A wall or floor 28*a*, preferably formed of an ABS plastic material, separates the first and second waterproof chambers and an interior surface 28*b* provides the mounting surface for the interior components of the first waterproof chamber 26 (i.e., light source, switch, etc.). Depressions 28*c* provide the power supply locations. In a preferred embodiment of the invention, the power supply comprises three batteries 16*a*, only one of which is shown, arrayed along the sides of an equilateral triangle, as shown and described in the above-mentioned U.S. Published Patent Application 2006/0250789 A1. Additionally, a center depression 28*d* can be provided and fitted with a magnet 29. The magnet 29, which can be cemented in position, provides further mounting structure. The employment of the silicone and ABS plastic materials for the body provide the additional benefit that the total density of the package is less than that of water; i.e., it will float.

An opening 20 in the housing 12 permits egress of light when the light source 14 is energized and a flexible, transparent cover 22 is peripherally sealed to the opening 20 in a watertight manner. As illustrated, the sealing is achieved by an adhesive 22*a* applied to the peripheral flange 22*b* of the cover 22 and the interior edge 22*c* of the opening 20; however, other constructions are possible. For example, the peripheral flange 22*b* can be over-molded into the housing 12.

Figure 1:
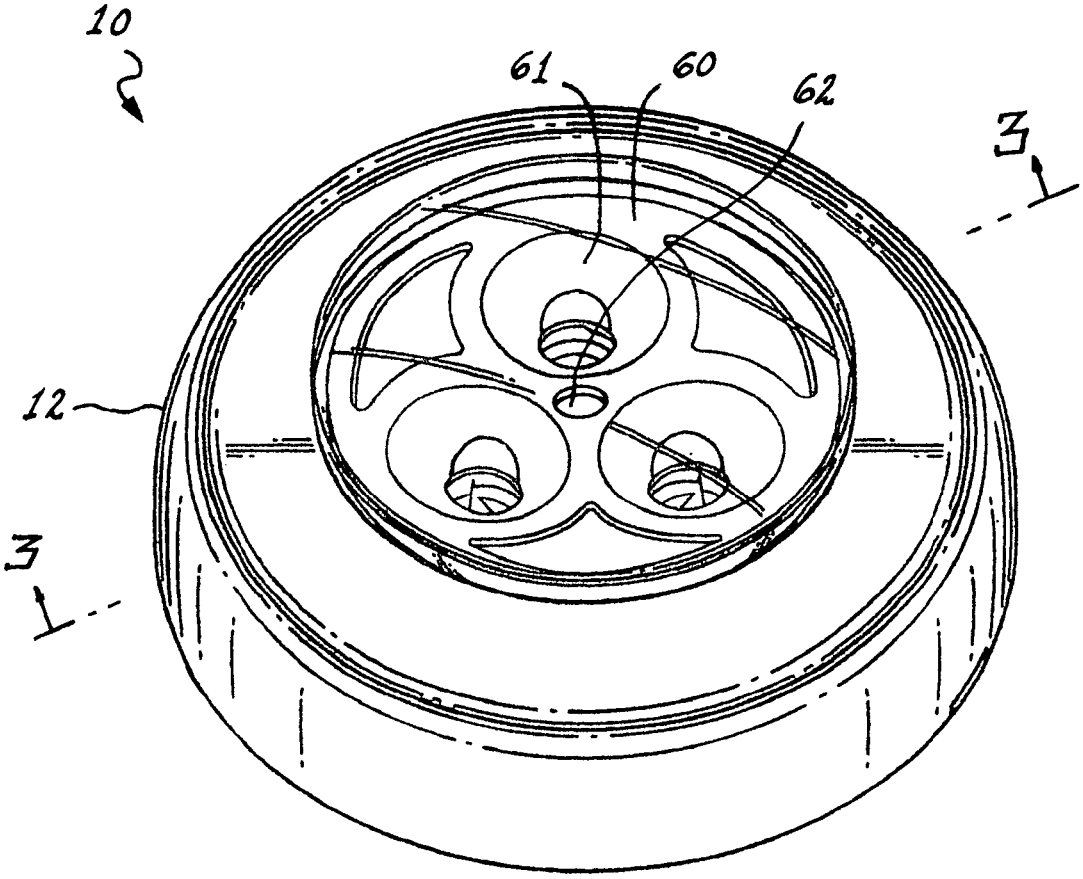
FIG. 1 is a perspective view of an embodiment of the invention

A switch activator 24 is substantially centrally located on and fixed to the flexible, transparent cover 22, as by a suitable transparent cement. In the interest of clarity, the switch activator 24 is eliminated from FIG. 1. Alternatively, the switch activator can be molded as an inherent part of the cover 22. A suitable reflector 60 is provided to direct the light from the light source 14, via cone-shaped portions 61, to a field to be illuminated and is provided with a switch activator receiving opening 62 centrally located therein.

In a preferred embodiment of the invention, the flexible, transparent cover 22 has a durometer hardness between 30 and 40. This provides the cover 22 with a flexibility ratio D/CD=6, where "D" is the diameter of the cover and "CD" is the center deflection of the cover.

The housing 12 further includes a sealing portion 40; and a base 32 including a planar bottom 34, an upstanding wall 36 and an annular sealing gasket 38 positioned in the bottom 34. The base 32 cooperates with the sealing portion 40 of the housing 12 to provide a waterproof seal for the second chamber 28 when the base 32 is affixed to the housing 12. The outer surface 34*a* of the bottom 34 can be provided with a suction cup 34*c*, or waterproof adhesive to provide the lamp with even more mounting capabilities.

Figure 2:
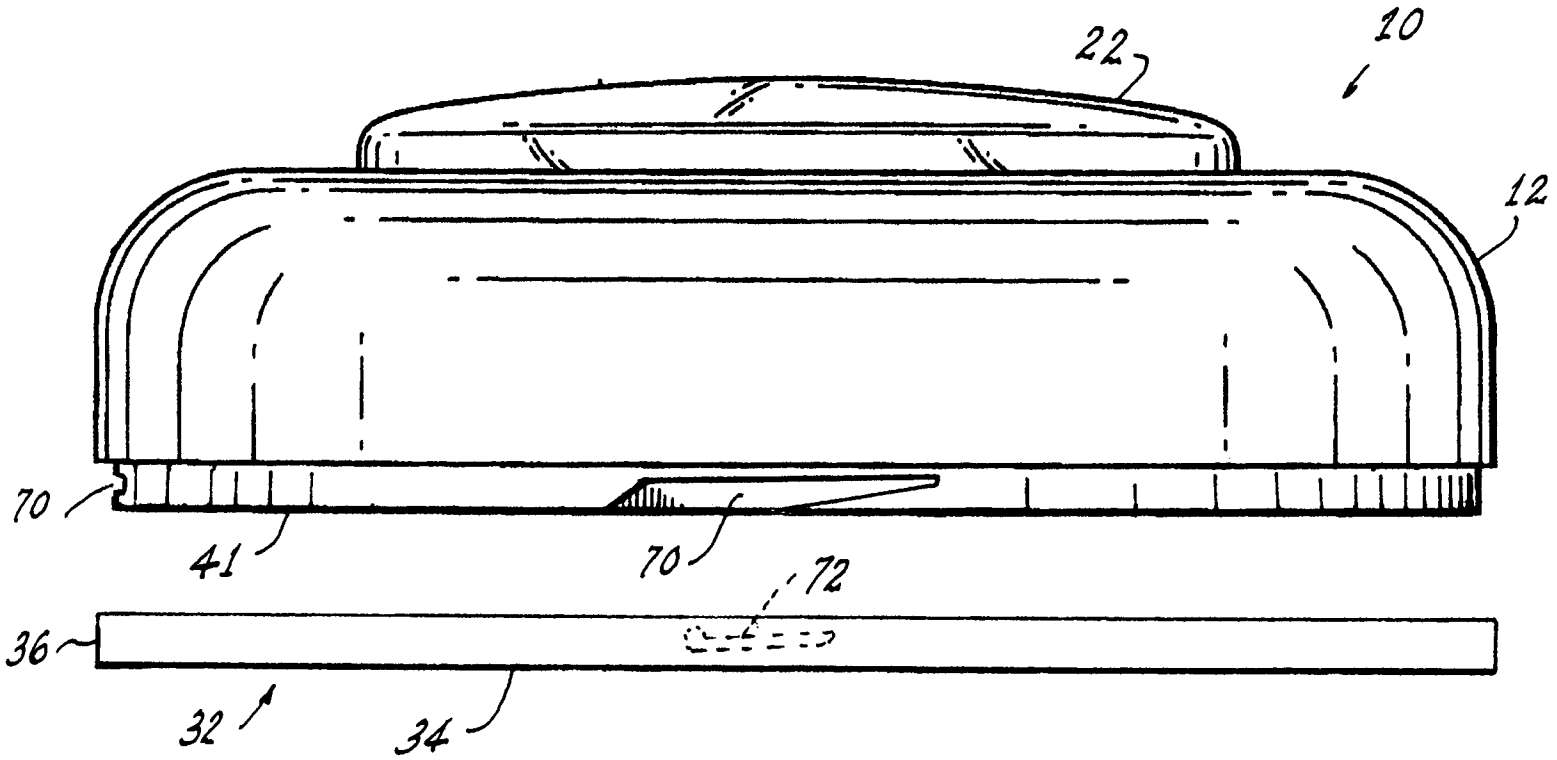
FIG. 2 is a side elevational view of an embodiment of the invention.

Affixation of the base 32 to the housing 12 can be by any suitable means, such as threaded couplings, however, in a preferred embodiment of the invention, affixation is by a lug and groove system, such as shown in FIG. 2 wherein the grooves 70 (three are preferred, 120 degrees apart) are formed on lip 41 of housing 12 and cooperate with lugs 72 formed on the interior of wall 36 of base 32.

Thus there is provided a portable, waterproof lamp that is convenient to use and mount in many water environments.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A waterproof portable lamp comprising:

a housing including a first waterproof chamber and a second waterproof chamber, said housing defining an opening, the housing including a flexible transparent cover peripherally sealed to the opening of the housing in a waterproof manner;

a light source and a switch for actuating said light source positioned in said first waterproof chamber; and a replaceable power supply for said light source positioned in said second waterproof chamber, said second chamber being isolated from said first chamber except for electrical connections between said power supply and light source.

2. The waterproof portable lamp of claim 1 wherein said housing further including a sealing portion; and a base including a planar bottom, an upstanding wall and an annular sealing gasket positioned in said bottom, said base cooperating with said portion of said housing to provide a waterproof seal for said second chamber when said base is affixed to said housing.

3. The waterproof lamp of claim 1 wherein the density of said lamp is less than the density of water.

4. The waterproof portable light source of claim 1 wherein said opening permits egress of light when said light source is energized; and a switch activator is substantially centrally located on and fixed to said cover.

5. The waterproof portable lamp of claim 4 wherein said cover has a durometer hardness between 30 and 40.

6. The waterproof portable lamp of claim 4 said cover has a flexibility ratio D/CD =6, wherein D is the diameter of the cover and CD is the center deflection of the cover.

7. A waterproof portable lamp comprising:

a housing including a first waterproof chamber and a second waterproof chamber, said first chamber defining a single closed chamber;

a light source and a switch for actuating said light source positioned in said first waterproof chamber; and a replaceable power supply for said light source positioned in said second waterproof chamber, said second chamber being isolated from said first chamber except for electrical connections between said power supply and light source.

8. The waterproof lamp of claim 7, wherein the lamp is capable of floating in water.

* * * * *